United States Patent [19]

Cohen

[11] 3,976,195

[45] Aug. 24, 1976

[54] SEALED PACKAGE OF SWAB OR APPLICATOR STICK AND MEDICINAL MATERIAL TO BE APPLIED THEREBY

[75] Inventor: Sheldon S. Cohen, Chicago, Ill.

[73] Assignee: Modern Medical Concepts, Inc., Chicago, Ill.

[22] Filed: Feb. 26, 1975

[21] Appl. No.: 553,110

Related U.S. Application Data

[63] Continuation-in-part of Ser. No. 461,912, April 18, 1974, abandoned.

[52] U.S. Cl. ..... 206/362

[51] Int. Cl.[2] ..... B65D 81/02

[58] Field of Search ..... 206/209, 210, 362, 363

[56] References Cited

UNITED STATES PATENTS

| | | | |
|---|---|---|---|
| 1,241,977 | 10/1917 | Hippins | 206/209 |
| 3,032,177 | 5/1962 | Majors | 206/209 X |
| 3,056,493 | 10/1962 | Berryman et al. | 206/362 |
| 3,527,400 | 9/1970 | Shepherd et al. | 206/363 X |
| 3,603,453 | 9/1971 | Serrell et al. | 206/532 X |
| 3,618,751 | 11/1971 | Rich | 206/363 X |
| 3,738,480 | 6/1973 | Chesley | 206/534 |
| 3,746,161 | 7/1973 | Jones | 206/72 |
| 3,759,375 | 9/1973 | Nappi | 206/209 |

*Primary Examiner*—Leonard Summer

*Attorney, Agent, or Firm*—Wallenstein, Spangenberg, Hattis & Strampel

[57] ABSTRACT

An improved assembly is provided of a sealed package, one or more disposable handled swabs or applicator sticks and a medicinal material to be applied by the heads of the swabs or applicator sticks. Where the medicinal material is a liquid, the liquid is substantially completely absorbed by the cotton-tipped heads of the swabs so no body of flowable liquid is present. The package is formed preferably by a tray-forming body of material molded to provide for each swab or applicator stick a well that serves loosely to receive the head portion thereof and isolate it from external compression forces, and an inclined support ledge to position the handle portion thereof so it inclines upwardly and away from the well. A cover sheet of a gas-impervious material is secured over the tray-forming body to provide a gas-tight seal that is selectively openable to provide access to the swabs or applicator sticks. The handles of the swabs or applicator sticks preferably are engaged and depressed by the cover sheet to hold the swabs or applicator sticks securely within the package.

1 Claim, 14 Drawing Figures

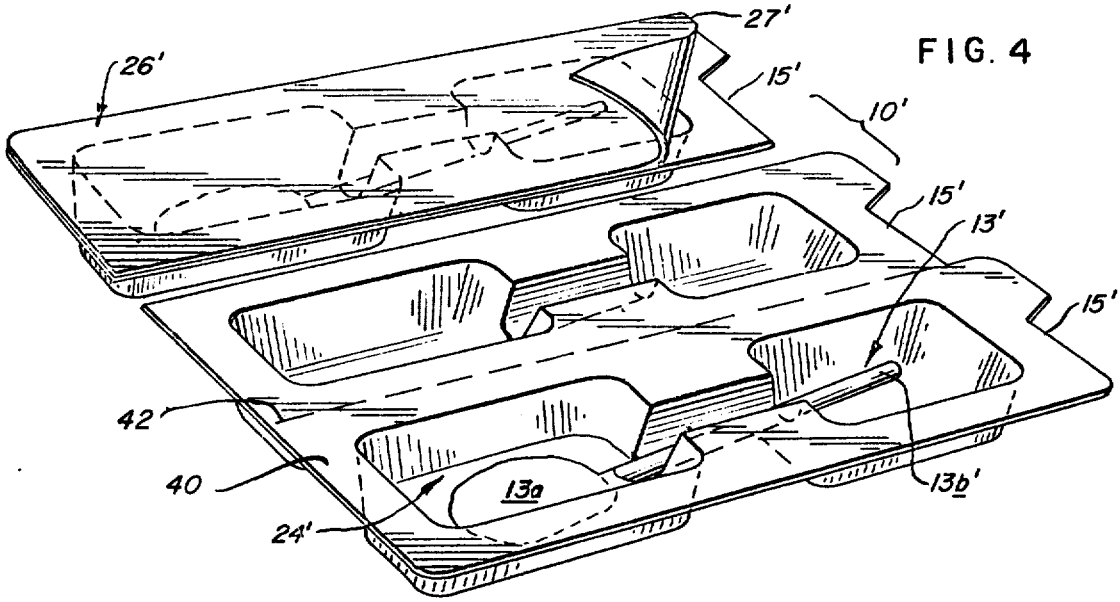
FIG. 4
FIG. 5
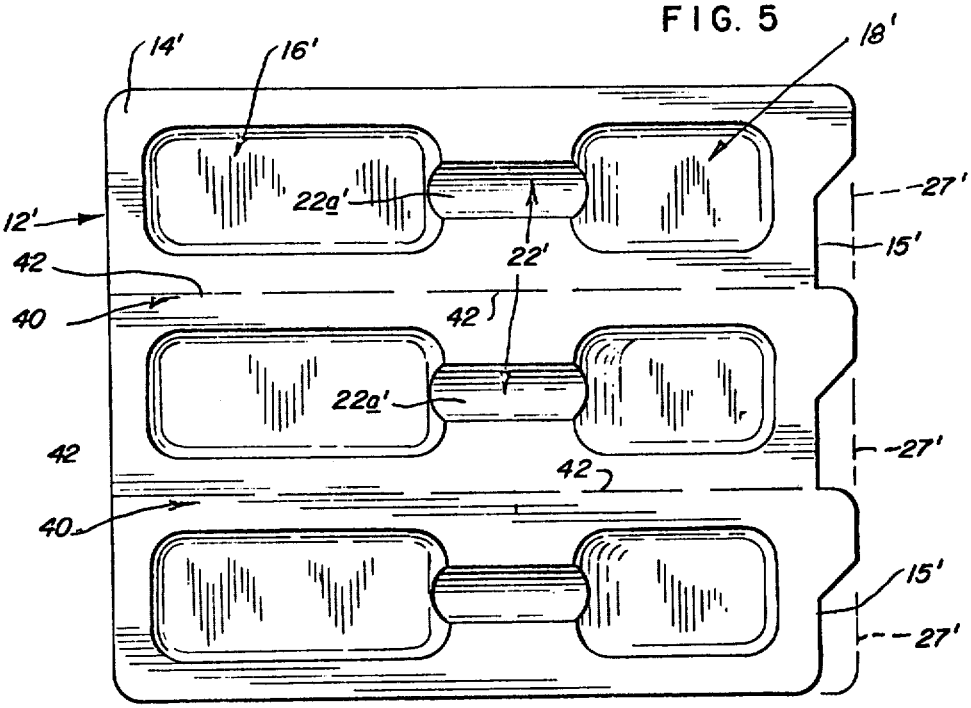
FIG. 6
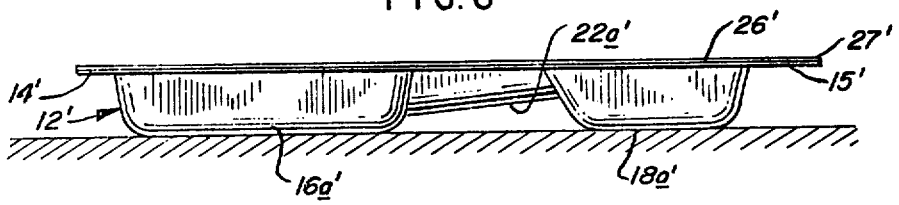

SEALED PACKAGE OF SWAB OR APPLICATOR STICK AND MEDICINAL MATERIAL TO BE APPLIED THEREBY

RELATED APPLICATION

This application is a continuation-in-part of application Ser. No. 461,912, filed Apr. 18, 1974, and entitled, SEALED PACKAGE OF SWAB OR APPLICATOR STICK AND MEDICINAL MATERIAL TO BE APPLIED THEREBY, now abandoned.

BACKGROUND OF INVENTION

This invention relates to a sealed package in which are sealed one or more pre-packaged disposable cotton-tipped liquid applying swabs or jelly or cream applying applicator sticks and the material to be applied by the heat portions thereof.

The pre-packaging of medicinal applicators like cotton tipped swabs and a liquid or cream-like material for use by doctors and medical technicians have heretofore been accomplished by enclosing one or a plurality of such applicators and a quantity of medicinal material to be applied by the head portions thereof within a flexible rupturable sack-like envelope. In those cases where the medicinal material is a liquid, it has generally been the practice to supply a substantial excess of such medicinal material so that there is a body of liquid within the envelope. While applicant knows of no such example, even if in such case the medicinal material is applied directly to the cotton-tip heads of these applicators in an amount just to saturate the same, the stacking or handling of such envelopes would create such pressures on the applicator heads that appreciable liquid would be forced from the heads thereof so a body of the liquid medicinal material would be present in the envelope. (Note that to under-saturate a cotton-tipped head could undesirably leave uncoated areas thereon, and to just saturate the head introduces a control problem which was probably not considered worth the effort involved.)

Such prior constructions have a number of disadvantages. First of all, the body of liquid material in the envelopes wets the handle portions of the swabs, making them sticky and unpleasant to handle. Additionally, when the presence of a body of liquid medicinal material was desirable for repeated application of such material by the same or different applicators, difficulty was encountered in storing the remaining contents of an opened envelope.

As disclosed in U.S. Pat. No. 3,759,375, it has been heretofore proposed to package disposable swab-type applicators in a tray having severable sections, wherein each section comprises a tray-forming body with a depression forming a well for receiving the head portion of a swab-type applicator and the excess of the liquid material to be dispensed thereby, and a depression for receiving the handle portion of the swabtype applicator. A seal-forming projection extends from the handle and sealingly fits within a depression in the tray to seal off the well from the handle-receiving depressions of the tray. A cover sheet sealing encloses the upper surface of the tray section involved and completes the sealing of the well-forming depression from the handle-receiving depression of the tray section. Such a swab-type applicator package is relatively costly to manufacture since it does not utilize a conventional inexpensive swab-type applicator. Also, the applicators disclosed therein are supported in a perfectly horizontal position in the tray and the cover sheet passes in the immediate vicinity of the applicator heads, so external compression forces on the applicator heads could squeeze medicinal material therefrom. Additionally, if the tray construction shown in this patent were modified to support a number of such swab-type applicators in a common tray where the handles thereof all are exposed in a single compartment for simultaneous removal and use by one hand, but with the heads thereof sealed in separate recesses as disclosed in the patent, the sealing fit required between the seal-forming projections of the swab applicators and the tray would prevent the easy removal of a number of swab-type applicators simultaneously from the tray.

Frequently, it is desired to use a number of applicators in a definite sequence as, for example, where it is desired to initially apply a disinfectant and cleaning material to a given area of the patient's body using one swab-type applicator, then remove the cleaning and disinfectant material from the area involved with a dry swab-type applicator, and then apply a medicinal preparation to the same area. In the prior art, such applicators to be used in succession were completely separately packaged and so the nurse or doctor had to select in the proper sequence the applicators from completely separate packages.

An object of this invention is to provide an improved package construction for one or more handled swabs or applicator sticks of conventional and/or inexpensive (as contrasted to an expensive special) construction and a medicinal material to be applied thereby, and wherein the construction and arrangement thereof are such that wetting of the handles by any excess medicinal material is eliminated or minimized.

Another object of this invention is to provide an improved package construction for one or more handled swabs or applicator sticks of conventional and/or inexpensive (as contrasted to an expensive special) construction and a medicinal material to be applied thereby, and wherein the construction and arrangement thereof are such that the swabs or applicator sticks can be removed more easily from the package than in the case of the envelope packages or the sealed swabs of U.S. Pat. No. 3,759,375.

Still another object of this invention is to provide a package as described for a number of handled swabs or applicator sticks where upon the first opening of the package a number of handled swabs or applicator sticks may be easily simultaneously removed by one hand.

Another object of this invention is to provide a unique packaging system which facilitates the application of a number of different applicators to be applied in sequence to a given area of a patient's body.

A further object of this invention is to provide an improved package construction for a pre-packaged swab or applicator stick and material to be applied thereby as described, this is characterized by a simple and economical construction.

Further objects and advantages will become apparent as the description of this invention proceeds, reference being had to the drawings illustrating preferred embodiments of the invention.

SUMMARY OF INVENTION

In accordance with one of the features of the invention, a sealed applicator package is provided that includes a tray-like body preferably made of molded synthetic plastic material providing depressed well and support ledge-forming portions shaped and arranged to cooperate respectively with the head and handle of one or more handled swabs or applicator sticks so as to locate the head portions thereof below the handles and in head protecting wells, and with the portions of the handles to be grasped inclining and/or spaced upwardly so as to be out of contact with any bottom surfaces of the tray. In such case, the swabs or applicator sticks can be most conveniently grasped. The package is completed by a flexible, gas-impervious, cover sheet that is releasably but sealingly secured over the tray-like body to provide a gas-tight seal thereover. Since the handles incline upwardly away from the applicator head-receiving wells, should a body of liquid medicine be desirably present in the applicator head-receiving wells, if the medicinal preparation flows upon the applicator handles when the package is inverted, the medicine would then drain from the handles when the package is upright.

In accordance with another aspect of the invention, the liquid medicine wetted heads of the swabs lying in a well in a rigid tray-like body covered by a preferably non-rigid cover sheet are isolated by external forces by being spaced substantially from the cover sheet. Thus, the problem of wetting the handles of the swabs with medicinal material is avoided altogether by applying the liquid medicinal material to the heads of the swabs in controlled amounts so the heads are not oversaturated, but preferably just or almost fully saturated. In such case, none of the medicinal liquid will ever appear as a flowable body of liquid in the well of the tray-like body.

The present invention has its most important applications in two basically different forms of packages. In one form, each of the swabs or applicator sticks is sealed within a separable section of the tray-like body of the package. In the other form, the tray-like body of the package is a non-separable body and supports a number of swabs or applicator sticks either in a single compartment, whereupon removal of a single nonseverable cover sheet therefrom all swabs or applicator sticks are simultaneously visible and preferably graspable at one time, or in separate compartments where each can be exposed separately as a severable portion of an overlying cover sheet is peeled from the tops of the package. The latter package construction, when the different severable portions of the cover sheet are numbered in order of the use of the associated swabs or applicator sticks, is particularly useful when the patient's body is to be wiped by the swabs or applicator sticks in a given sequence.

In these forms of the invention, unlike other previous tray-like package constructions, the tray-like bodies are designed to receive conventional swabs or applicator sticks, so that both the package and the swab or applicator sticks form a sealed disposable assembly which can be manufactured and sold at a modest cost in comparison to those packages which are designed to accommodate specially constructed and designed swab-type applicators, as previously described. Other aspects of the invention deal with the relative shape of the margins of the tray-like body and the extent of the cover sheet to simplify the process of peeling the cover sheet from the tray-like body.

BRIEF DESCRIPTION OF DRAWINGS

FIG. 4 is a perspective view of a form of the invention where the swabs are in individually sealed severable sections of the package, one of the severable sections of the package being shown separated from the rest of the package and with the cover sheet of the remaining portion of the package removed to show one section of the tray with a swab removed therefrom and another section of the tray with a swab contained therein;

FIG. 5 is a plan view of the tray-like body portion of the package of FIG. 4 before the separation of one of the package sections therefrom with the cover sheet and the swabs removed therefrom;

FIG. 6 is an end elevational view of the package shown in FIG. 4;

DESCRIPTION OF DRAWINGS

Figure 1:
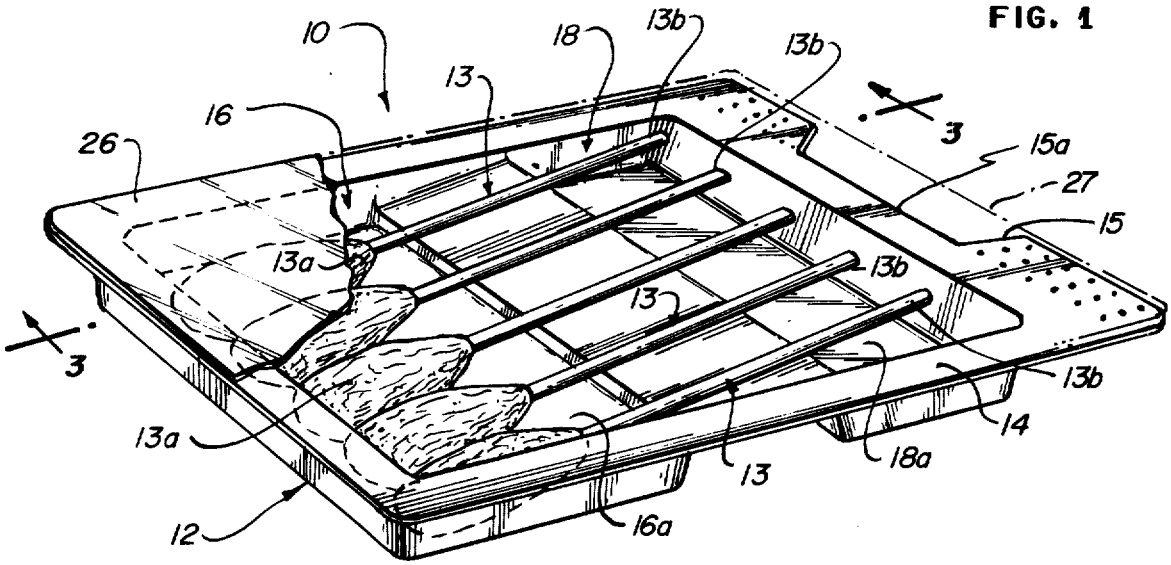
FIG. 1 is a perspective view of one form of package holding a number of conventional handled swabs which are simultaneously exposed upon removal of the cover sheet, which has been broken away to show the exposed swabs.
Figure 2:
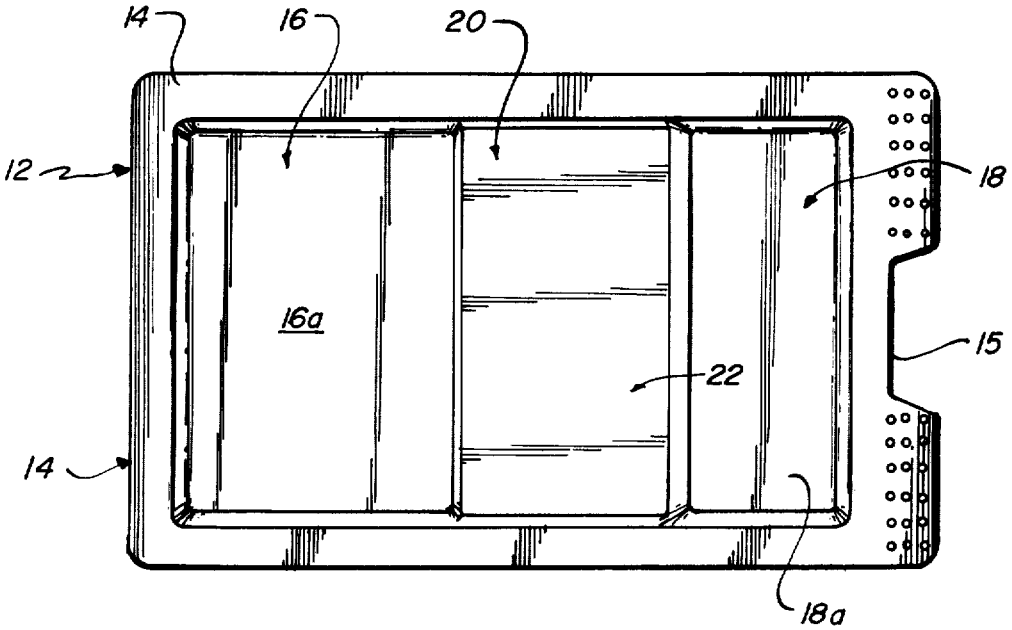
FIG. 2 is a top plan view of the package of FIG. 1 after removal of the swabs and cover sheet thereof.
Figure 3:
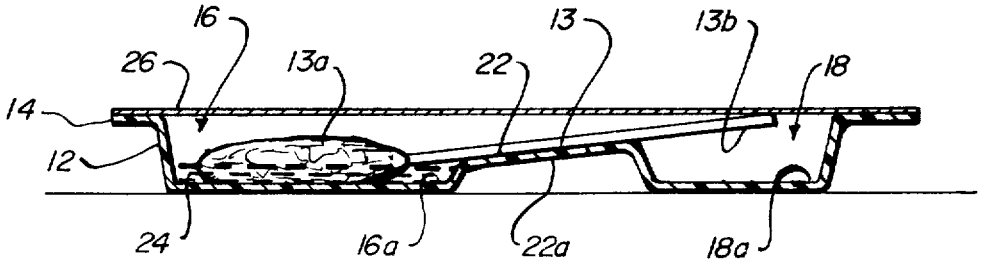
FIG. 3 is a vertical sectional view through the package of FIG. 1, taken along section line 3—3 thereof.

Referring now to the drawings, a first exemplary package embodying the invention herein is shown in FIGS. 1–3, which shows a sealed package 10 constructed for enclosing therein a plurality of handled swabs each indicated generally at 13. The package 10 includes a tray-like body 12 preferably formed from a molded synthetic plastic material, such as high density linear polyethylene about 0.015 – 0.025, preferably 0.020, inches thick (which material is compatible with all if not most medicinal materials applied by swabs and applicator sticks). The tray-like body 12 provides a continuous, substantially planar, peripheral shelf or ledge 14 of substantial width at the uppermost surface thereof that surrounds a single open-top compartment having a plurality of intercommunicating storage portions for receiving thereinto head and handle portions 13*a* and 13*b* of the swabs 13. The storage portions include a single applicator head-receiving well 16 for containing the head portions of all of the swab handles, a single finger-receiving well 18 over or into which extends the free ends of the swab's handles, and a central portion 20 interposed between the wells 16 and 18. The central portion 20 of the tray-like body 12 preferably is formed by an inclined raised wall portion 22*a* forming a flat upwardly and rearwardly inclined swab handle support surface or ledge 22 terminating at its ends with the wells 16 and 18. This permits closer crowding together of a plurality of swabs in a package, thereby reducing the size and cost of the package. In a less preferred form of the invention not shown in the drawings, the central portion between the two wells 16 and 18 can comprise spaced parallel depressions each receiving the handle portion of one swab.

As best seen in FIGS. 1 and 3, the swab 13 has a head portion 13*a* that is adapted to be received in the well 16, and the length of the handle portions 13*b* is such as to extend beyond the length of the inclined raised wall portion 22*a*, causing the end of the handle portion 13*b* distal from head portion 13*a* to be located substantially within the confines of well 18 but preferably projecting slightly above the same when the tray-forming body 13 is uncovered. Preferably the uppermost end of the support ledge 22 is spaced well above the lower defining walls 16*a* and 18*a* of wells 16 and 18.

The material to be applied by the swab may be a liquid, cream or jelly like substrate 24 (FIG. 3) which can flow upon the swab handle if the package would be supported in an upside down, vertical or substantially inclined position where the side of the package containing the swab handles was at the bottom thereof. In FIG. 3, the material 24 is shown in the form of a body of liquid that will gravitate to the lower portion of the well 16 where the swab head portions 13*a* are normally positioned when the package is properly supported in a horizontal position. The inclined support ledge 22 formed by the raised wall portion 22*a* permits any of the liquid 24 draining on the ledge to flow into the well 16 when the package in a sealed state is inverted or tilted and then properly positioned on a horizontal support surface. The inclined support ledge 22 also, as previously explained, serves to incline the handle portions 13*b* upwardly and rearwardly so that the distal or free ends of the handle portions 13*b* are spaced well above the lower wall 18*a* of well 18 to provide for convenience in grasping said free ends of the swab handles, and to permit the liquid 24 which may reach the handles during shipment or improper storage readily to drain therefrom.

The bottom walls 16*a* and 18*a* of the spaced wells 16 and 18 are located in a single plane that is spaced maximally from and preferably parallel to the plane of the peripheral shelf of the tray-like body, so as to provide a relatively flat stable support for the package when the package is supported on a horizontal support surface as shown in FIG. 3.

A cover sheet 26 of a gas-impervious material is provided for overlying and sealing the tray-like body 12. Cover sheet 26 has peripheral portions thereof releasably and sealingly secured to the continuous peripheral shelf 14 so as to provide a selectively separable liquid and gas-tight seal between the cover sheet 26 and the tray-like body 12. In its preferred form, the cover sheet 26 includes a thin sheet of aluminum foil, but may also be of a flexible, transparent, synthetic plastic material. Sheet 26 is secured by means well known in the art, such as through an adhesive, heat sealing or chemical bonding to the flat peripheral shelf 14 of the tray-like body.

The sealed package shown in FIGS. 1–3 which enables all five applicators simultaneously to be grasped between two fingers of the user's hand is especially suitable for use in female urinary catheterization. A similar three swab-containing package (not shown) is useful in male urinary catheterization.

As previously indicated, in the preferred form of the invention, the swab handle extends up above the level of the peripheral ledge 14 where the application of the cover sheet applies a small force against the handles to stabilize the position of the swabs in the package. The weight or tackiness of the liquid, cream or jelly impregnated head portions of the applicators keep the same in position in the bottom of the well 16.

The outermost edge of the peripheral shelf 14 is provided with at least one indentation 15 relative to the outermost edge of the cover sheet 26 so as to provide a completely exposed section of cover sheet material which can be grasped between the projected lines 15*a* and 27 as seen in FIG. 1, to provide means for selective separation of the cover sheet from the tray-like body 12 when the package is to be opened. As seen in FIG. 3, the cover sheet depresses the swab handles slightly to stabilize the position of the swabs in the package. When the cover sheet is removed, one or more swabs can be readily removed simultaneously from the tray-like body.

In the modified form of package shown in FIGS. 4–6, elements similar to elements heretofore described in connection with the description of FIGS. 1–3 are given the same reference numerals with primes (′) added thereto. The package 10′ includes tray-like sections with a planar continuous peripheral shelf 14′ and inclined support ledge-forming elongated depressions 22′ formed by inclined walls 22*a*′, swabs 13′ with handle portions 13*b*′ in depressions 22′ and a cover sheet 26′ over the tray-like body. The form of construction shown in the modified form of FIGS. 4–6 specifically provides for sub-sectioning the package to provide individual packages for each swab 13′ separated from the other swabs. Thus, the tray-like body 12′ is provided with a plurality of separated spaced swab head-receiving wells 16′ and separated spaced handle-receiving wells 18′ into which the head and handle portions 13*a*′ and 13*b*′ respectively extend. The inclined bottomed depressions 22′ interconnect the associated pairs of wells 16′ and 18′. Each swab head-receiving well 16′ is adapted to receive thereinto a measured quantity of liquid or other material 24′ to be applied by the head of the swab. Each communicating set of wells 16′ and 18′ of the tray-like body is separated from the adjacent set of interconnecting wells 16′ and 18′ by a separator section 40 thereof located in the plane of the peripheral shelf 14′ and being of a length to extend between a pair of spaced parallel sections of the peripheral shelf 14', as shown in FIGS. 4 and 5.

Figure 6A:
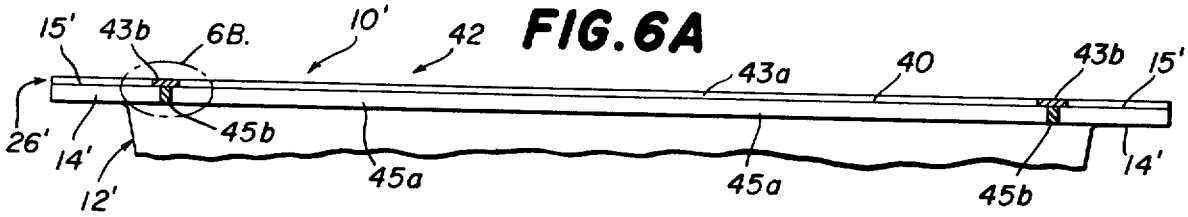
FIG. 6A is a vertical sectional view through the package shown in FIGS. 4–6 at a point where sections of the package are severable and FIG. 6B is a magnified view of a portion of the package shown in FIG. 6A at the point encircled by dashed lines therein.
Figure 6B:
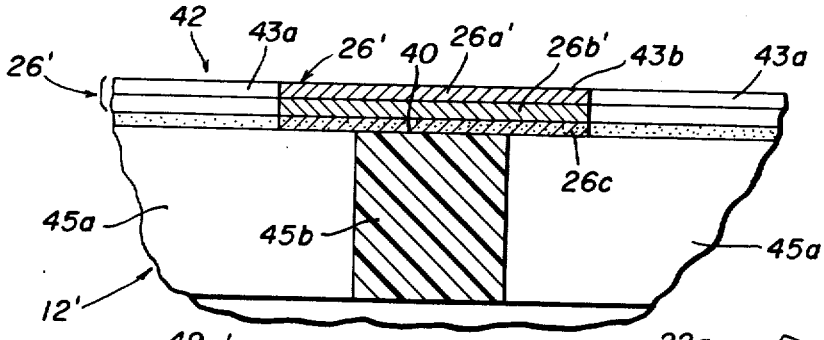

Each of the sub-sections of the package 10' is provided with an indentation 15' so that when cover sheet 26' is adhered to the continuous peripheral flange 14', there will exist sections of cover sheet material that can be grasped, one for each sub-section of the package. In order to provide that the sub-sections of the package 10' may be separated along each interior margin thereof located centrally of each separator strip, a line 42 of separation is provided in the form of slots, perforations or the like, as is well known in the art. The slots or perforations should extend through both the thickness of the material of the tray-like body 12' and the thickness of the material of the cover sheet 26'. Such an arrangement permits separation of individual units as needed as illustrated in FIG. 4 where the uppermost or distal sub-section of the package has been separated from the two sub-sections that remain secured together. Since the synthetic plastic material out of which the tray-like body 12' is made is a fairly tough material, to ease the force necessary to separate the various tray body sections from one another, as shown in FIGS. 6A and 6B these sections are severed at **45*a* along the separator strip for most of the length thereof, except for a few small readily severable pin-head sized webs 45*b*** which interconnect the tray-like body sections referred to. The tray-like body is perforated in this way before the cover sheet is applied thereto.

The cover sheet 26' as shown in FIG. 6B most preferably comprises an upper layer **26*a'* made of a paper-like material and upon the outer face of which is printed information identifying the type of applicator involved and the medicinal material applied to the head portion thereof, and a trademark or logo identifying the manufacturer of the product. The paper layer 26*a'* is secured by a suitable adhesive or the like to an aluminum foil layer 26*b'*, in turn, shown coated with a thin layer of a suitable heat sealable adhesive layer 26*c'* which may be, for example, polypropylene. The adhesive layer 26*c'* is heat sealed to the peripheral shelf 14' and separator strips 40 of the tray-like body 12'. The peripheral ledge 14' of the tray-like body has indentations 15' to expose portions of the cover sheet which can be grasped for peeling the same from the tray-like body section therebelow, once the section of the tray-like body has been severed from the rest of the same. The cover sheet 26' readily peels from the tray-like body along a severance line 42. Because the cover sheet is much more readily severable than the synthetic plastic material of the tray-like body 12', as shown in FIGS. 6A and 6B, before being applied to the tray-like body 12' the cover sheet is severed along lines coextensive with the desired locations of the severance lines 42 at portions 43*a* occupying a smaller proportion of the length thereof than the tray body severance portions 45*a* leaving, as illustrated, a number of relatively wide webs 43*b* interconnecting the adjacent sections of the cover sheet 26'**.

Figure 7:
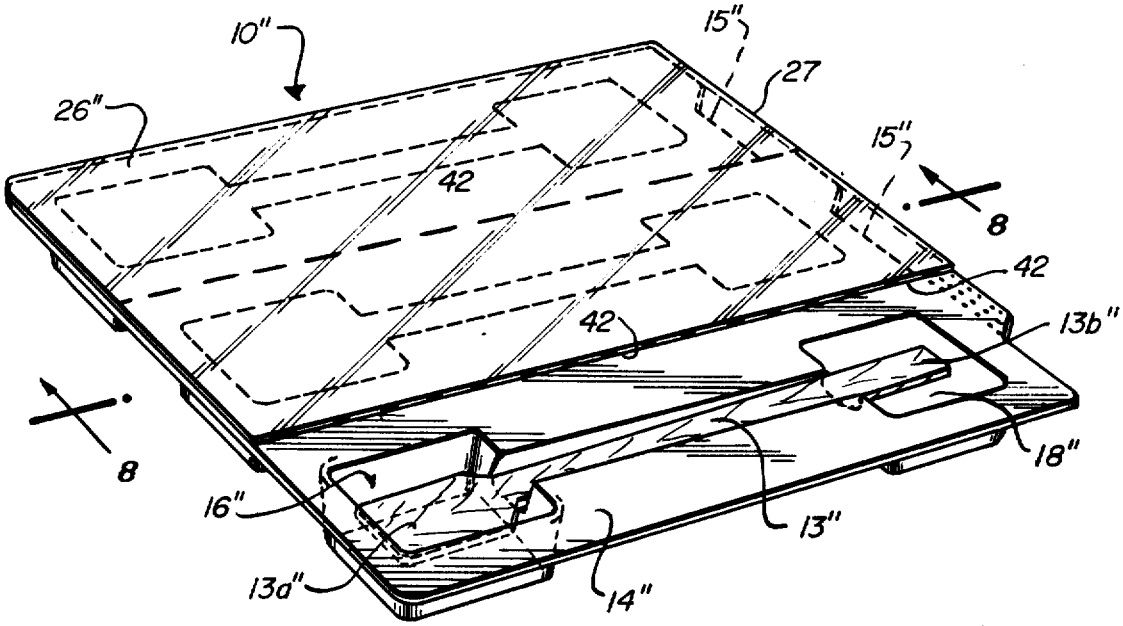
FIG. 7 is a perspective view of a package for supporting applicator paddle sticks therein, the applicator sticks being separately sealed within severable sections of the package, and with the cover sheet on one of the sections removed to show the applicator stick therebeneath.
Figure 8:
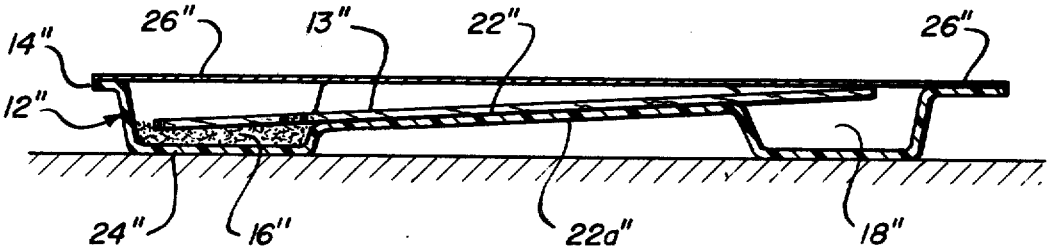
FIG. 8 is a transverse sectional view through the package of FIG. 7, taken along section line 8—8 thereof.

In the embodiment of the invention shown in FIGS. 7 and 8, a package 10'' similar to that shown in FIGS. 4–6 is shown but modified to support applicator paddle sticks 13'' having a paddle-like head portion **13*a''* and a handle portion 13*b''*. The applicator paddle sticks are utilized to apply cream or jellylike materials, whereas the swabs 13 and 13' previously illustrated are conventional cotton-tipped swabs for applying liquid-type materials. In all other respects the package 10'' of FIGS. 7 and 8 is like that shown in FIGS. 4–6, and similar reference numerals have been shown for corresponding elements except a double prime (''') has been added to the reference characters. Since the package 10'' is used exactly in the same way as the package 10'** previously described, further description thereof is believed unnecessary.

In the forms of the invention illustrated in FIGS. 1–6 the head portions of the swabs lie in a body of the medicinal material involved. However, by a later improvement in the present invention it was conceived that if the tray constructions shown protect the head portions of the swab applicators from external forces because the head portions of the swabs are spaced substantially from the cover sheet of the tray-like body involved, the problem of wetting of the handles with liquid medicinal material is avoided altogether if the liquid mecidinal material is dropped in controlled amounts directly upon the cotton-tip heads of the swabs or applicators to a degree where the heads are not supersaturated but are just or almost fully saturated therewith. In such case, none of the medicinal liquid will ever appear as a body of liquid in the wells 16 or 16' of the tray-like bodies 12 or 12'. Such a package **10*a* is shown in FIGs. 9–12 to which reference is now made. As shown in FIG. 12, each well 16*a* of the tray-like body 12*a* is substantially dry of the liquid medicinal material, or at least sufficiently dry that no body of such a material is present which can flow into other portions of the package. As indicated, this is best achieved by dripping the liquid medicinal material directly upon the cotton-tip heads of the applicators preferably after they are applied to the tray-like body 12*a*** there shown (or less preferably before they are applied to the tray-like body).

Figure 9:
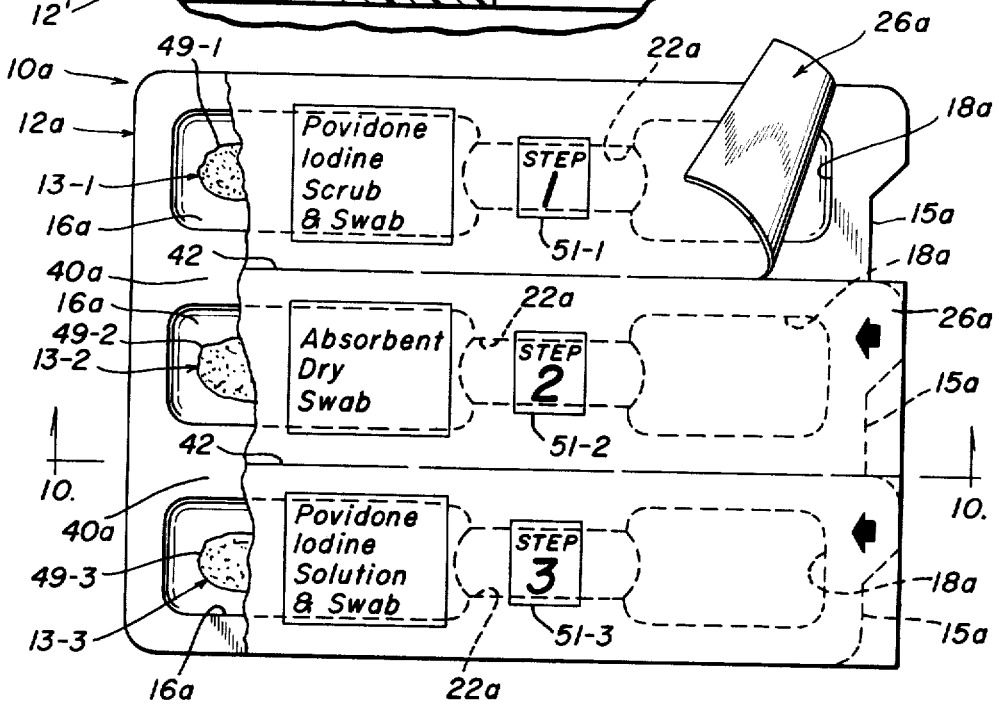
FIG. 9 is a plan view of still another form of the present invention wherein the form of the package illustrated has a non-severable tray-like body having individual compartments therein supporting handled swabs to be applied to an area of the patient's body in a given sequence, the cover sheet of the traylike body being severable and one of the severable portions thereof being therein shown in the process of being peeled from the tray-like body.
Figure 10:
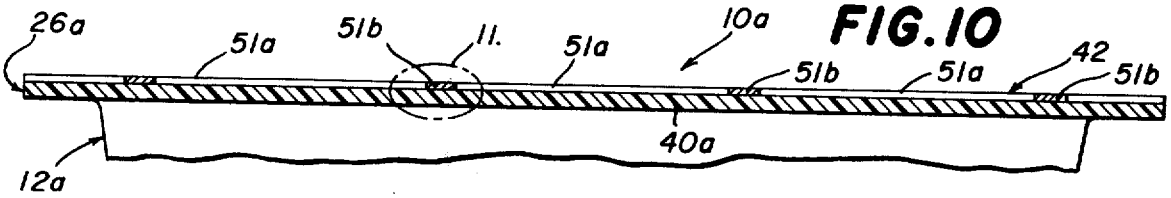
FIG. 10 is a vertical enlarged sectional view through the package shown in FIG. 9 along section line 10—10 thereof, which is at the plane where two severable portions of the cover sheet of the tray-like body come together.
Figure 11:
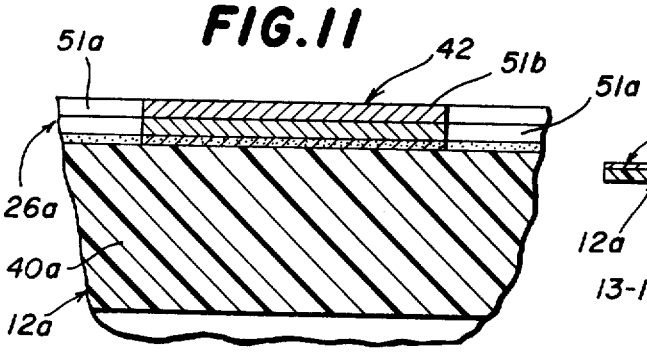
FIG. 11 is a magnified view of a portion of the package shown in FIG. 10 at the point encircled by a dashed line therein.
Figure 12:
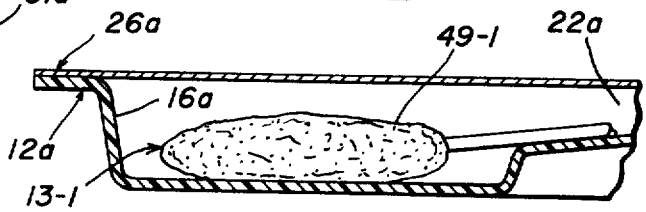
FIG. 12 is a fragmentary enlarged vertical sectional view of the package of FIG. 10, taken through an applicator head-receiving well.

The form of the invention illustrated in FIGS. 9–12, in addition to the improvement just discussed, also illustrates another very important form of the invention where it is desired to use a number of applicators in a definite sequence. Thus, as illustrated in the plan view of FIG. 5, the tray-like body **12*a* is substantially identical to that shown in FIG. 4 except that there are no perforations between the separator strips 40*a* thereof, so that the tray-like body is not severable into sections. The tray-like body 10*a* has the various applicator-receiving recesses or wells 16*a*, 22*a* and 18*a* in each compartment of the three sections of the tray-like body illustrated. The uppermost swab 13-1 as viewed in FIG. 9 has a povidone iodine material applied to the cotton-tip head portion 49-1 thereof which is used as a first step in the medical procedure involved to clean and disinfect a venipuncture on the patient's skin. The swab 13-2 in the middle section of the tray-like body 12*a* has a cotton-tipped head portion 49-2 which is utilized to clean the area applied with the iodine composition applied by the swab 13-1. The swab 13-3 in the bottom section of the tray-like body as viewed in FIG. 5 has a solution of povidone iodine applied to the cotton-tipped head portion 49-3 thereof. The cover sheet 26*a* is perforated in the same way described in connection with the cover sheet 26' in the embodiment of the invention shown in FIGs. 4–6, so that different sections of the cover sheet overlying the different sections of the tray-like body can be separately peeled from the tray-like body. FIG. 11 shows the manner in which cover sheet 26*a* is perforated, and it can be seen that these perforations 51*a* are spaced to leave severable web portions 51*b* which permit the different sections of the cover sheet to be readily separated from one another. To this end, the tray-like body has spaced indentations 15***a* along one margin thereof exposing the cover sheet 26*a* for grasping between two fingers of the user's hand, so that the different sections of the cover sheet can be readily peeled in sequence from the tray-like body in the order of the sequence number indicia 51-1, 51-2 and 51 3 appearing on the cover sheet 26*a* (FIG. 9).

Thus, the highly unique package 10*a* permits the user to readily apply in a given predetermined sequence the various swabs 13-1, 13-2 and 13-3 contained in different sections of the tray like body. Because the cover sheet 26*a* is separately severable in sections over the inseparable compartmentalized tray-like body, the user never gets confused as to what particular swab is to be applied first, as would be the case, for example, if the cover sheet were removable only as a total unit from the tray-like body 12*a*. In such case, after peeling off the cover sheet, the user would see three different swabs at one time, and would have no idea what particular applicator swab is to be used first unless he recalled the orientation of the cover sheet with respect to the tray-like body before removing the cover sheet therefrom.

From the foregoing description, it will be readily understood how the packages 10, 10′, 10″ and 10*a* are to be used. The completely exposed portions of the cover sheets 26, 26′, 26″ and 26*a* provide means for grasping and pulling the same from the associated tray-like body to expose the interior of the packages. The elevated distal end of the swab or applicator stick handles located in well 18, 18′, 18″ or 18*a* is easily graspable and the swab or applicator stick is then used in its normal manner to apply the material in well 16, 16′, 16″ or 16*a* to the surface that is to be treated. Each swab or applicator stick is intended for single use to avoid contamination, and while all the swabs in the package of FIGS. 1–3 are exposed when the package 10 is opened, the swabs remaining in the package are maintained in usable position and attitude as seen in FIG. 3, and the package may be stored for later use as needed. In the forms of the invention shown in FIGS. 4–12, a single one of the sub-portions of the package may be separately opened to expose only the single swab or applicator stick and, as shown in FIGS. 4–8, separated completely from the other package portions.

It will be appreciated that numerous changes and modifications can be made to the embodiments disclosed herein without departing from the spirit and scope of this invention.

What I claim:

1. A combination medicinal applicator and sealed package assembly therefor comprising: at least one applicator element having a liquid absorbent applicator head portion for applying a medicinal material and an elongated handle portion for handling the same; a sealed package enclosing said at least one applicator element comprising an initially open top tray-like body made of rigid material and initially having an opening in the top thereof through which the applicator element can pass into and from the body, said body having a rigid peripheral ledge extending around the same, said body having in the bottom thereof an applicator head-receiving well into which the head portion of said applicator element extends and support means above the bottom of said body tray and below said ledge inclined upwardly from said well upon which the handle portion of said applicator element is supported an end portion of said handle being adjacent a finger-receiving well so that the handle can be readily grasped, said wells being unsealed from each other, a medicinal material wetting at least part of the head portion of said applicator element to a point where it is not super-saturated so the well is free of any flowable body of such material; and a manually removable cover-forming means comprising a sheet of flexible material sealed along said peripheral ledge, and enclosing the open top of said body to provide a gas and liquid tight seal with said body so the applicator element is sealed from the exterior of the package; said head portion of the applicator element being spaced from said cover sheet in said well when said tray-like body is upright so a downward force on said cover sheet is not applied to said head portion of said applicator element and said applicator head portion is also protected from an external force by the rigid walls of the tray-like body when the body is inverted.

* * * * *